United States Patent [19]

Lin et al.

[11] Patent Number: 4,890,204

[45] Date of Patent: Dec. 26, 1989

[54] BALL POINT PEN WITH SELF-PROVIDED ILLUMINATOR

[76] Inventors: Shyh-Ling Lin; Yeong-Sung Lin, both of 8F-2, 375 Hsin-Yi Road, Sec 4, Taipei, Taiwan

[21] Appl. No.: 158,503

[22] Filed: Feb. 22, 1988

[51] Int. Cl.[4] ..... B43K 29/10; F01L 21/00

[52] U.S. Cl. ..... 362/118; 362/208; 362/119

[58] Field of Search ..... 362/118, 119, 109, 32, 362/120, 208, 157

[56] References Cited

U.S. PATENT DOCUMENTS

| | | | |
|---|---|---|---|
| 975,465 | 11/1910 | Schnapka | 362/32 |
| 1,193,534 | 8/1916 | Friedman | 362/118 |
| 2,407,106 | 9/1946 | Shelly | 362/32 |
| 3,604,917 | 9/1971 | Schmidt | 362/118 |
| 4,016,414 | 4/1977 | Browning et al. | 362/118 |
| 4,168,521 | 9/1979 | Bajusz | 362/118 |
| 4,518,274 | 5/1985 | Hanggi | 362/118 |
| 4,737,894 | 4/1988 | Kuch et al. | 362/118 |

*Primary Examiner*—Ira S. Lazarus
*Assistant Examiner*—D. M. Cox
*Attorney, Agent, or Firm*—Klein & Vibber

[57] ABSTRACT

The present invention comprises a ballpoint pen with self-illumination, comprising a writing device and an illuminating device. The two independent parts, the writing device and the illuminating device, are coupled together by a screw joint. Said illuminating device is equipped with a lamp to emit light which is reflected via a lamp reflector and a light reflecting sleeve, through the pen holder of the writing device so as to light up a writing surface.

1 Claim, 3 Drawing Sheets

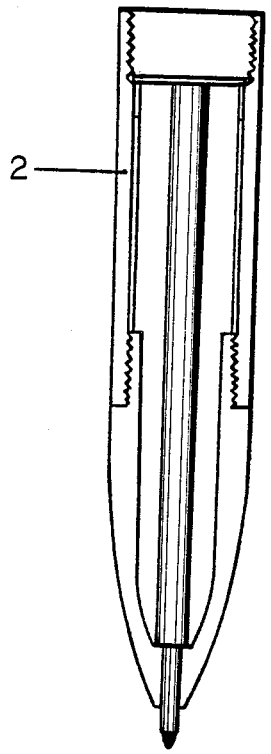
FIG:2A
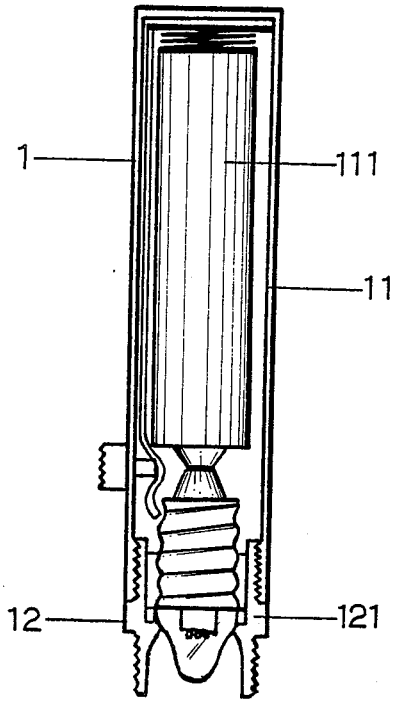
FIG:2B
FIG:2

BALL POINT PEN WITH SELF-PROVIDED ILLUMINATOR

BACKGROUND OF THE INVENTION

Many professional people like doctors, nurses, military personnel, pilots and student needs some type of writing implement, such as a pen, which self-illuminates a writing surface when the illumination of a room is insufficient to clearly see the the writing surface being written upon.

This problem is not new and it has been solved with a large variety of self-illuminating pens.

SUMMARY OF THE INVENTION

The present invention relates to a new design for ballpoint pens, especially a pen that has a self-illuminating source for use in the dark. This illumination is caused by a lamp situated inside the battery part of the pen. The light is emitted via a lamp reflector, a reflector sleeve and the pen holder and through the pen nib. The pen and the illuminating device are two independent parts coupled together by a screw joint to form the present self-illuminating pen.

BRIEF DESCRIPTION OF THE DRAWINGS

For an understanding of the principles of the invention, reference is made to the following description of a typical embodiment thereof as illustrated in the accompanying drawings.

FIG. 2 is a sectional view of the preferred embodiment in detached forms.

DETAILED DESCRIPTION OF THE INVENTION

Figure 1:
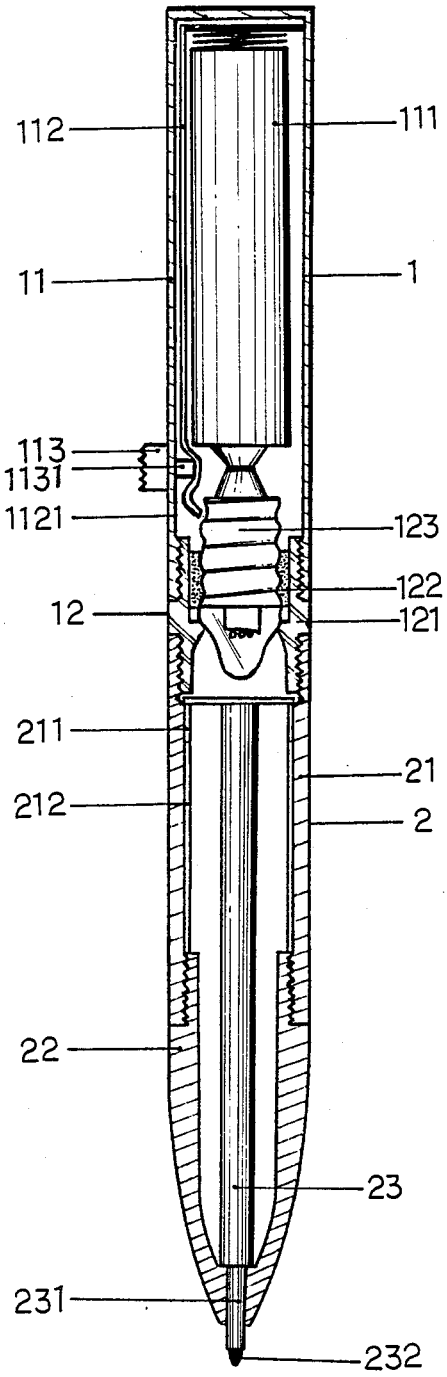
FIG. 1 is a sectional view of the whole body of the preferred embodiment.

As shown in FIGS. 1 and 2, the pen is composed of an illuminating device (1) and a writing device (2) that are coupled together by means of a screw joint. Said illuminating device (1) comprises a round, opaque tube (11) which is screwed together by a screw joint to a luminary socket (12). The tube (11) contains, for example, a battery power source (111). The negative pole of the power source (111) is connected to an electrically conductive spring leaf (112), that is firmly fixed to the inner wall of the tube (11). The positive pole of the power source (111) is connected directly to the lamp holder of the lamp bulb. Said spring leaf (112) is controlled by a sliding switch (113) that protrudes outside the tube (11). The sliding of the terminal post (1131) of the sliding switch (113) drives the endpoint (1121) of the spring leaf (112) to make contact or break contact with the conductor of the lamp bulb.

The luminary socket (12) comprises a lamp reflector (121), where the front end of the socket has a bowl-like shape with a small opening at one end to place a lamp bulb inside. The surface of the inner wall of the socket (121) is covered with a light reflecting agent. Said lamp reflector (121) is threaded on its outer walls so that it can be screwed together between the illuminating tube (11) and the writing device (2). Said lamp reflector (121) also comprises an elastic washer (122) in the inner wall in the rear end of the socket, to act as a buffer for the location of the lamp bulb (123). The front part of said lamp bulb (123) is placed inside the lamp reflector (121) and its rear end is directly connected with the positive pole of the power source (111). For electric conduction the copper covered lamp socket is aimed at the endpoint (1121) of the spring leaf (112), so that the sliding switch (113) can effeciently control the circuit to ON or OFF position.

The writing device (2) is composed of a combining tube (21), a pen holder (22) and a writing cartridge (23). Said combining tube (21) is an opaque tube which is threaded at both ends on its internal walls to enable screw joint connection with the lamp reflector (121) and the pen holder (22). At the end of the inner wall of the combining tube (21) near the lamp reflector (121), there is a small transparent tubular ring (211) which is followed by a light reflecting sleeve (212), for condensing and reflecting ahead to the ballpoint nib, the light emitted by the lamp (123). The pen holder (22) is a transparent tubular ring. The front end of the pen holder (22) has a smaller caliber for the writing cartridge to be located. The rear end of the pen holder (22) is threaded for a screw joint connection with the combining tube (21).

The writing cartridge (23) comprises an ink cartridge (231) and a pen nib (232).

The assembled ballpoint pen is shown in FIG. 1. When the sliding switch (113) is pushed forward, the switch terminal post (1131), presses the end-point (1121) of the spring leaf (112) to contact the conductive metal of the lamp holder, so light is turned on. The emitted light is then reflected by the lamp reflector (121) to the light reflecting sleeve (212) where the light is condensed and reflected forward through the transparent pen holder (22).

When detached, as shown in FIG. 2, the illuminating device (1) and the writing device (2) can be used independently, i.e. the writing device becomes an independent ballpoint pen and the illuminating device becomes an independent flash light.

Figure 3:
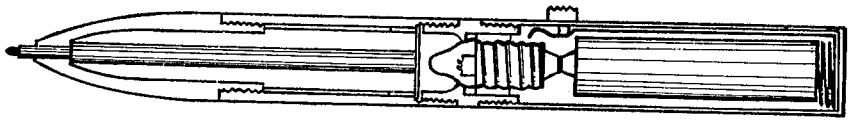
FIG. 3 is a perspective of the preferred embodiment.

In practice, the actual size of the present invention is as shown in FIG. 3. The power source is a 1.5 V UM-4 battery; the lamp is a 15 bulb; the full length is 140 mm (smaller than the regular ballpoint pen); the outer diameter of the pen is 15.5 mm and the writing cartridge can be as long as 63 mm. For convenience, a removable pen cap can be attached to the pen holder to protect the pen nib.

All the above mentioned is just the spirit of the invention, any change or modification shall be included in the category of the patent solicited.

We claim:

1. A ballpoint pen with self provided illumination, comprising an illuminating device that includes a power source arranged in an illuminating tube, an electrically conductive spring leaf being fixed to a sliding switch operatively mounted in said tube for connecting one pole of the circuit, the other pole of the power source being directly connected with the end-point of a lamp bulb mounted inside a lamp reflector, said lamp reflector is coupled with said illuminating tube by means of a screw joint;

a writing device comprising an opaque combining tube, a transparent pen holder, a writing cartridge and a ballpoint pen nib operatively connected to each other, said combining tube comprising on the inner wall a transparent tubular ring for holding the writing cartridge in an operative position and a light reflecting sleeve coupled with the pen holder by means of a screw joint, said writing cartridge being mounted inside the writing device with the ballpoint pen nib protruding beyond the pen holder for writing, and said writing device being coupled with the illuminating device by means of a screw joint.

* * * * *